US005232378A

United States Patent [19]

Weingartner

[11] Patent Number: 5,232,378

[45] Date of Patent: Aug. 3, 1993

[54] ELECTRICAL PLUG-IN CONNECTION

[75] Inventor: Bernhard Weingartner, Feldkirch, Austria

[73] Assignee: Neutrik Aktiengesellschaft, Schaan, Liechtenstein

[21] Appl. No.: 930,754

[22] Filed: Aug. 14, 1992

[30] Foreign Application Priority Data

Sep. 4, 1991 [DE] Fed. Rep. of Germany ..... 4129386

[51] Int. Cl.[5] ..... H01R 13/627

[52] U.S. Cl. ..... 439/354; 439/357

[58] Field of Search ..... 439/345, 350, 351, 353, 439/354, 357, 358

[56] References Cited

U.S. PATENT DOCUMENTS

| | | | |
|---|---|---|---|
| 1,677,734 | 7/1928 | Smith | 439/353 X |
| 3,192,499 | 6/1965 | West | 439/354 |
| 4,261,628 | 4/1981 | Gallagher et al. | 439/354 X |
| 5,120,234 | 6/1992 | Mergless | 439/357 |

FOREIGN PATENT DOCUMENTS 2652755 6/1977 Fed. Rep. of Germany .

*Primary Examiner*—Larry I. Schwartz
*Assistant Examiner*—Khiem Nguyen
*Attorney, Agent, or Firm*—McAulay Fisher Nissen Goldberg and Kiel

[57] ABSTRACT

Electrical plug-in connection includes two plug parts to be coupled. Each plug part has a plug housing with a contact element carrier arranged therein, which contact element carrier is outfitted with contact elements and is produced from electrically insulating material. One plug part has an axially parallel pawl with a ratchet, and the housing of the other plug part has an undercut cooperating with this ratchet in the manner of a locking bar. The pawl carrying the ratchet is cut out of and free from the outer surface area of the plug housing by two notches extending substantially axially parallel at a distance from one another and a notch extending transversely relative to the latter. The substantially axially parallel notches extend along a first housing portion to be received by the other plug part and along an adjoining second housing portion. The second housing portion has an outer diameter which is larger than that of the first housing portion.

5 Claims, 2 Drawing Sheets

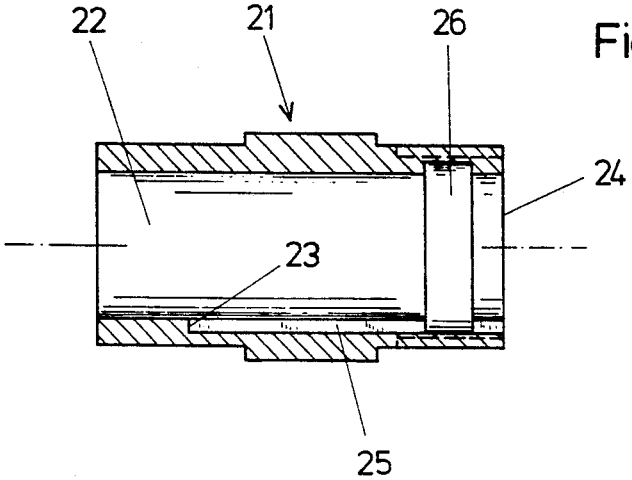
Fig. 5
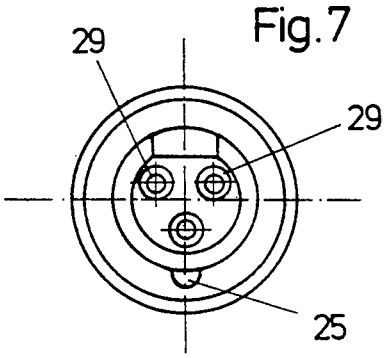
Fig. 7
Fig. 6
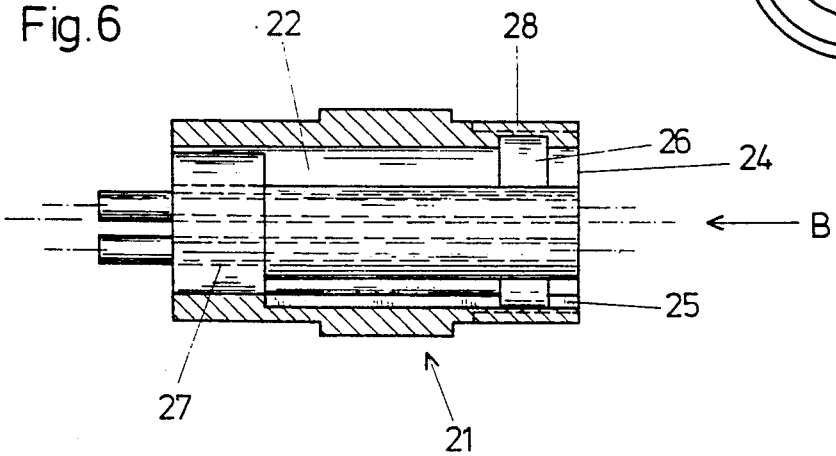
Fig. 8
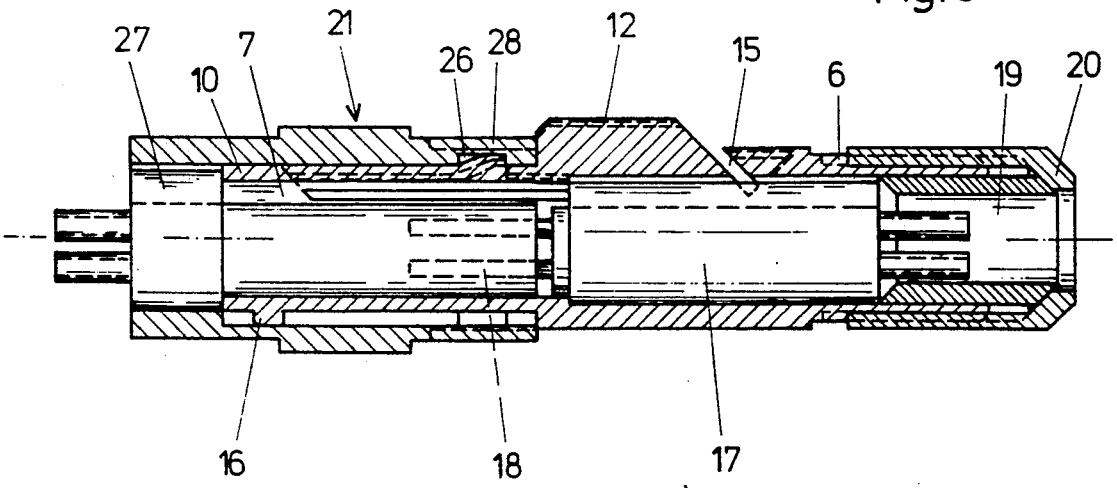

ELECTRICAL PLUG-IN CONNECTION

BACKGROUND OF THE INVENTION a) Field of the Invention

The invention is directed to an electrical plug-in connection and, more particularly, a plug-in connection having at least two plug parts to be coupled, each plug part having a plug housing with a contact element carrier.

b) Background Art

Plug-in connections are required for the mechanical, and accordingly electrical, serving of electrical signal or power transmission lines at a desired location. An electrical plug-in connection therefore includes devices for the mechanical connection of two elements, known as coupling plugs and coupling sockets, as well as means for producing and serving electrical contact. Plug-in connectors are therefore conventionally constructed in such a way that insulating bodies are arranged as contact carries in a mechanical housing which preferably comprises metal but can also be manufactured from plastic. The mechanical housings serve to protect these contact carriers on the one hand and produce the mechanical connection of the plug halves on the other hand. These plug halves can be freely connected with cables or lines and serve to lengthen the cable or—in the majority of cases—a plug which is freely mounted on a cable is plugged into a fixedly installed socket on the apparatus side.

As a rule, it is desirable or necessary that this mechanical connection be effected in a positive-locking manner and it should be possible to disconnect this positive-locking engagement quickly by means of a suitable arrangement. Thus, a locking mechanism will be present. In the simplest case the latter is a union nut, also known as a Hollaender, which is arranged over the housing of the free plug and engages in a suitably arranged screw thread at the counter-plug. Another widely used variant has a spring pawl mechanism in which a spring-loaded pawl engages with a ratchet in a corresponding undercut (recess) of the counter-plug and can be detached (unlocked) by means of pressing on a button arranged on the pawl.

A common characteristic of all these mechanisms is that they include a plurality of structural component parts and accordingly cannot be produced inexpensively and, above all, require a construction of considerable size so that the plug is either unnecessarily large or the space needed for electrical contacts is done away with. Yet modern electronics with its progressive miniaturization requires reliable plug-in connectors of the smallest possible construction. Miniature microphones or the numerous miniature sensors used for monitoring machines and plants come to mind in this context.

SUMMARY OF THE INVENTION

The present invention shows a way to produce a locking mechanism which operates in a reliable manner and is far superior to all previous solutions with respect to its simplicity and especially its small construction size. In accordance with the invention, an electrical plug-in connection comprises at least two plug parts to be coupled. Each plug part has a plug housing with a contact element carrier arranged therein. The contact element carrier is outfitted with contact elements and is produced from electrically insulating material, one plug part having an axially parallel pawl with a ratchet. The housing of the other plug part has an undercut cooperating with the ratchet in the manner of a locking bar. The pawl carrying the ratchet is cut out of and free from the outer surface area of the plug housing by two notches extending substantially axially parallel at a distance from one another and a notch extending transversely relative to the latter. The substantially axially parallel notches extend along a first housing portion to be received by the other plug part and along an adjoining second housing portion. The second housing portion has an outer diameter which is larger than that of the first housing portion. An actuating element for the pawl which is cut free projects over the housing in the region of the housing portion with the increased diameter. The plug housing, pawl, ratchet and projecting part serving as actuating element are constructed in one piece. The transversely extending notch is arranged in the second housing portion with the increased outer diameter and the plane of the transversely extending notch enclosing an acute angle with the longitudinal axis of the plug housing. The longitudinally extending notch intersect and penetrate one another. The contact element corner has a longitudinally extending cut out portion in the region adjacent to the pawl, which longitudinally extending cut out portion extends at least along the length of the pawl. The housing of the plug, which is preferably cylindrical, is produced as a thin-walled metal tube of suitable material, e.g. spring-hard brass, and corresponding notches and protuberances, respectively, in this housing ensure the three functions of such a pawl: namely the spring function by means of corresponding notches, the pawl function by means of a ratchet projecting out over the circumference, and the actuation function by means of a thickened portion for pressing down the locking pawl, which thickened portion likewise projects out over the circumference. The required machining processes can be implemented with modern automatic cutting machines.

In this context reference must also be made to the German Patent 26 52 755 which shows a plug-in connection corresponding to the conventional type of construction for such plug-in connections with respect to size. The free end of the tongue with the ratchet and the actuating element (gripping projection) contacts the front open end of the plug housing, the tongue extends over approximately two thirds of the length of this plug housing and the actuating element (gripping projection) is arranged approximately in the longitudinal center of the tongue. This tongue therefore possesses a sufficient elasticity so that it can easily be deflected via the actuating element (gripping projection) to disengage the lock when necessary. However, the electrical plug-in connection according to the present application is in miniature form. If the tongue in such a miniature form were constructed in the known manner so that its free end was situated in the area of the open front side of the housing, the tongue would obviously be much too rigid to serve as part of a deflectable locking mechanism. By shifting the free end of the tongue "to the rear" as it were, as proposed by the invention, this tongue can be made sufficiently elastic to be used as a movable part of the locking mechanism. Further, by inclining the cutting plane, sufficient free space is provided so that the actuating element can also move as required, and since the notches forming the tongue are actually produced by cutting processes, they must intersect and penetrate one another.

For a better understanding of the present invention, reference is made to the following description and accompanying drawings while the scope of the invention will be pointed out in the appended claims.

BRIEF DESCRIPTION OF THE DRAWINGS

In the drawings,

FIG. 5 shows the plug housing of the second plug part in longitudinal section;

FIG. 6 shows the plug housing according to FIG. 5, but with inserted contact element carrier;

FIG. 7 is a view of the second plug part according to FIG. 6 (as seen in the direction of arrow B); and FIG. 8 shows the two plug parts according to FIGS. 4 and 6 in longitudinal section and in contact-making connection.

DESCRIPTION OF THE PREFERRED EMBODIMENTS

Figure 2:
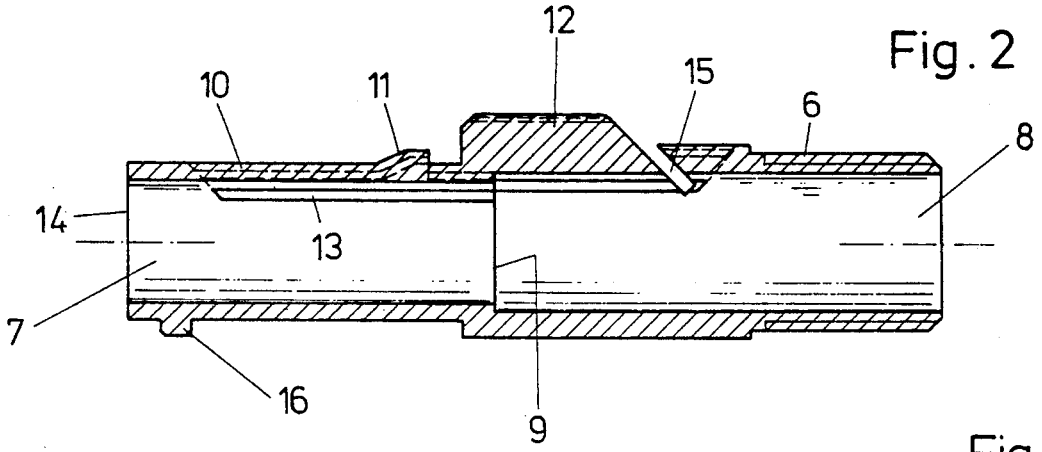
FIG. 2 shows the plug housing according to FIG. 1 in longitudinal section.

The plug housing 1 of the first plug part is constructed cylindrically and has a first or front housing portion 2 and a second housing portion 3 which adjoins the latter via a step-like shoulder 4 and has a larger outer diameter than the front housing portion 2. A housing part 5 with an external thread 6 adjoins the housing portion 3. As shown in FIG. 2, this plug housing 1 is penetrated by a longitudinal bore hole which has two bore hole portions 7 and 8 of different diameters. The step 9, which is accordingly formed by these portions, is situated in the center region. This housing 1 has a pawl 10. This pawl 10 extends over the first housing portion 2 and adjoining second housing portion 3. A ratchet 11 is located in the first housing portion 2. In the second housing portion 3, the pawl 10 projects over the outer surface area of the housing and forms an actuating element in the form of a button 12. This pawl 10, together with the ratchet 11 and the button 12 which projects out as actuating element, is worked out directly from the outer surface area of the plug housing 1 and is constructed so as to form one piece with the latter, specifically by means of two longitudinally extending, substantially axially parallel notches 13 which are arranged at a distance from one another and extend over the two housing portions 2 and 3 proceeding from the vicinity of one front side 14 of the plug housing 1. A transversely extending notch 15 is provided in the second housing portion 3, its cutting plane is advisably arranged diagonally relative to the longitudinal axis of the plug housing 1 and encloses an angle of approximately 30° to 45° with the latter.

A number of work steps are required for producing such a structural component part: a turned part is produced in a first work step and the axially parallel notches 13 are then produced with a disk milling cutter. The radially projecting, unnecessary portions are then removed in rough-turning processes. The transversely extending notch 15 is then milled and the rear thread is cut. In principle, it would also be possible to manufacture the ratchet 11 and the button 12 provided as the actuating element as separate structural component parts and then to fasten the latter on the pawl which is cut free from and out of the plug housing 1.

A guide protuberance is provided at the outside of the plug housing 1 having the free-cut pawl 10 so as to be set back relative to the front side 14 of this plug housing 1.

Figure 1:
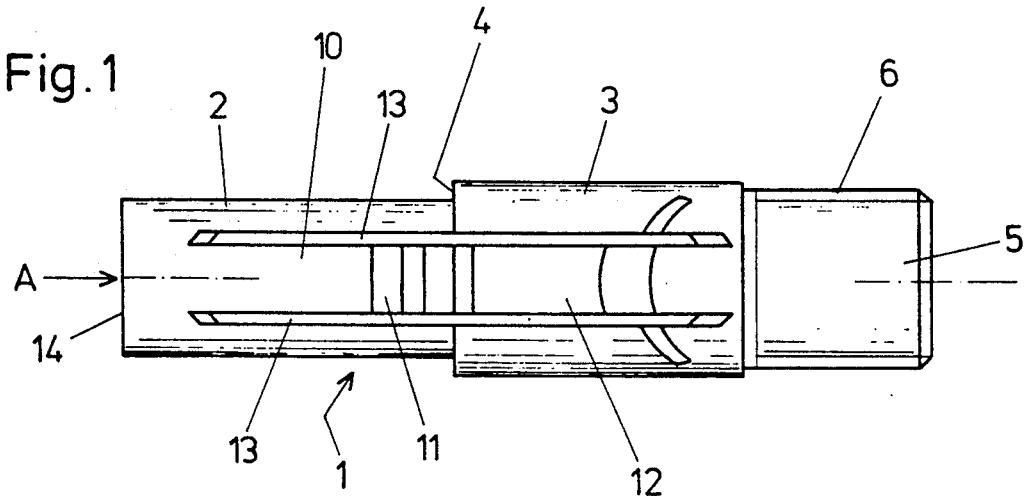
FIG. 1 shows the plug housing of the first plug part in plan view.
Figure 4:
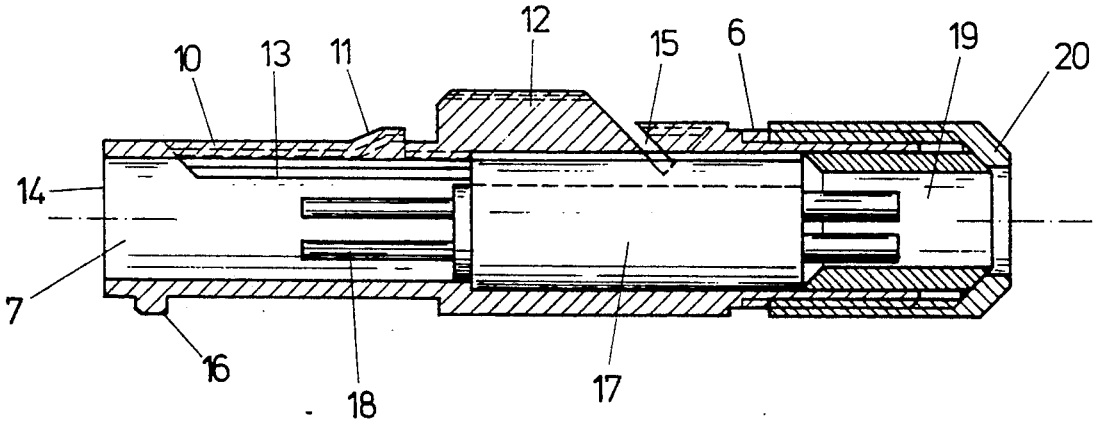
FIG. 4 shows the first plug part with the plug housing according to FIGS. 1 to 3 in longitudinal section and with inserted contact element carrier.
Figure 3:
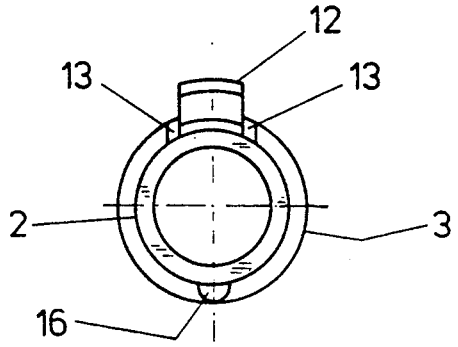
FIG. 3 is a view of the plug housing according to FIG. 1 (as seen in the direction of arrow A in FIG. 1)

FIG. 4 shows the first plug part with the plug housing according to FIGS. 1 to 3. The contact element carrier 17 is inserted into the plug housing 1 with contact pins 18 from the rear, i.e. from that side of the housing 1 carrying the external thread 6. This contact element carrier 17 contacts the inner step 9 of the plug housing 1 with its front side, a clamping sleeve 19 being provided at its rear side, which clamping sleeve 19 is constructed as a tubular piece with adjoining radially movable tabs. These tabs cooperate with the screw cap 20, which can be screwed on the external thread 6 of the housing portion 5, in such a way that the tabs are pressed in radially when the screw cap 20 is screwed on and, in so doing, the cable penetrating this clamping sleeve 19 is grasped in a clamping manner. The contact element carrier 17 is accordingly fixed in the provided position inside the plug housing 1 at the same time.

The contact element carrier 17 has a cut out portion in the area directly adjacent to the movable pawl 10 so that the pawl 10 can be moved in freely and in an unimpeded manner when the button 12 is actuated. It can be seen from FIG. 4 that the free ends of the contact pins 18 are set back relative to the cross-sectional plane in which the guide protuberance 16 is situated.

The plug housing 21 of the other plug part is shown in longitudinal section in FIG. 5. This plug housing 21 is also constructed cylindrically, has a stepped inner bore hole 22 with a step 23 and an axially parallel notch 25 proceeding from its front side 24. A circumferentially extending undercut 26 is provided at the inner wall of this plug housing 21 of the second plug part at a distance corresponding to the distance of the ratchet 11 from the shoulder 4 of the plug housing 1. The contact element carrier 27 (FIG. 6) is outfitted with contact sockets 29. The front side of the contact element carrier 27 is flush with the front side 24 of the plug housing 21 in this case. This plug part is constructed as a chassis plug. An external thread 28 is cut into the front portion of the plug housing 21 and a nut can be screwed on this external thread 28.

It is noted here that the external form of the plug housings 1 and 2 is not of primary importance for the invention; the present invention is also applicable in plug housings having an identical outer diameter along their length.

The aforementioned plug housings and plug parts are relatively large as shown in the drawing for the sake of simplicity. However, plug parts manufactured according to the present invention are extremely small. Some measurements are given as follows in order to convey some idea of the ratios of size: the plug part shown in FIG. 4 is approximately 30 mm long in all; the outer diameter of the front housing portion 2 is 4.5 mm. The axial length of the pawl 10 is approximately 14 mm.

Because of the smallness of the structural component parts, the contact elements also lie extremely close together in the contact element carriers 17 and 27. For this reason it is provided that the contact element carriers and contact elements, regardless of whether these are contact sockets 29 or contact pins 18, are furnished separately by the factory. For assembly, the individual contact elements are then connected with the conductor wires of a cable and only then are the contact elements inserted into the bore holes of the contact element carrier provided for this purpose, where they are anchored as a result of their special design which does not concern the present invention.

Since the diameters of the contact pins 18 are likewise very small, care must be taken that these contact pins do not assume any guidance or positioning function when assembling the plug parts. This must be avoided due to the construction design described above: as a result of the guide protuberance which is set back relative to the front side 14 of the plug housing 1 the front end portion of the plug housing 1, can be inserted into the housing 21 until the guide protuberance 16 contacts the front side 24 of the plug housing 21 without having to take into account a special radial positioning of the plug housings 1 and 21 beforehand. Only then are the two plug housings 1 and 21 rotated relative to one another until the guide protuberance 16 coincides with the notch or groove 25, at which point the plug parts can be joined since the contact elements 18 and 29 are also flush in this position of the guide protuberance 16 and notch 25.

The two plug housings 1 and 21 are pushed together until the shoulder 4 of the plug housing 1 contacts the front side 24 of the plug housing 21. At this point the ratchet 11 has also reached the undercut 26 and locks into the latter as a result of the elasticity of the pawl 10, thus mechanically securing the connection against disengagement. If the plug-in connection is to be electrically and mechanically severed, the pawl 10 is pressed in somewhat by pressing on the actuating element constructed as a button 12 so that the ratchet 11 disengages from the undercut 26 and the two plug parts can now be separated. When joining the plug parts, the pawl 10 is pressed down automatically as soon as the ratchet 11 starts to run up on the inside of the plug housing 21.

Due to the diagonal, transversely extending notch 15 the pawl 10 is prevented from being bent outward—deliberately or otherwise—and accordingly damaged. The diagonal surfaces resulting from the diagonal notch 15 prevent this outward bending and these surfaces form stops which outwardly define the movement of the pawl 10.

As can be seen in FIG. 1, the longitudinally extending notches 13 and the transversely extending notch 15 intersect and penetrate one another. As a result of this step, these notches can be produced by disk milling, which facilitates the manufacture of such a plug housing in which the pawl serving as a lock, including its actuating element and ratchet, is constructed in one piece with the housing and thus forms an integral structural component part of this plug housing. As a result of this proposal according to the invention, it is possible for the first time to outfit miniature plugs of the type described above with a locking device.

While the foregoing description and drawings represent the preferred embodiments of the present invention, it will be obvious to those skilled in the art that various changes and modifications may be made therein without departing from the true spirit and scope of the present invention.

What is claimed is:

1. Electrical plug-in connection comprising at least two plug parts to be coupled, each plug part having a plug housing with a contact element carrier arranged therein, which contact element carrier is outfitted with contact elements and is produced from electrically insulating material, one plug part having an axially parallel pawl with a ratchet, and said housing of the other plug part having an undercut cooperating with said ratchet in the manner of a locking bar; said pawl carrying said ratchet being cut out of and free from the outer surface area of the plug housing by two notches extending substantially axially parallel at a distance from one another and a notch extending transversely relative to the latter; said substantially axially parallel notches extending along a first housing portion to be received by the other plug part and along an adjoining second housing portion; said second housing portion having an outer diameter which is larger than that of the first housing portion; an actuating element for the pawl which is cut free projecting over the housing in the region of the housing portion with the increased diameter; said plug housing, pawl, ratchet and projecting part serving as actuating element being constructed in one piece, said transversely extending notch being arranged in the second housing portion with the increased outer diameter and the plane of the transversely extending notch enclosing an acute angle with the longitudinal axis of the plug housing; said longitudinally extending notches and transversely extending notch intersecting and penetrating one another; said contact element carrier having a longitudinally extending cut out portion in the region adjacent to the pawl, which longitudinally extending cut out portion extending at least along the length of the pawl.

2. Electrical plug-in connection according to claim 1, wherein a guide protuberance is provided diametrically relative to the cut-free pawl at the outside of the plug housing so as to be set back relative to the front side of this housing, and wherein a groove serving to receive this guide protuberance is provided at the inside of the plug housing of the other plug part.

3. Electrical plug-in connection according to claim 1, wherein said the contact elements are constructed as contact pins and contact sockets, wherein said free ends of the contact pins, relative to the front side of the plug housing receiving them, lie behind the cross-sectional plane of the plug housing in which the guide protuberance is arranged, and the insertion openings of the contact sockets of the other plug part lie in or behind the front plane of this plug housing.

4. Electrical plug-in connection according to claim 1, wherein the bore hole in the plug housing serving to receive the contact element carrier is stepped, wherein the inner diameter of the rear bore hole portion is greater than that of the front bore hole portion and wherein the contact element carrier is inserted into the plug housing from the rear and contacts the step formed by the different diameters, and wherein the plug housing carries a screwed on screw cap at its rear end, which screw cap is penetrated by the cable to be connected, wherein the inside of this screw cap contacts a clamping sleeve which is supported at the rear side of the contact element carrier, penetrated by the cable, and serves as a pull relief.

5. Electrical plug-in connection according to claim 1, wherein the plane of the transversely extending notch encloses an angle between 30° and 45° with the longitudinal axis of the plug housing.

* * * * *